US009333392B2

(12) United States Patent
Nakamura

(10) Patent No.: US 9,333,392 B2
(45) Date of Patent: May 10, 2016

(54) UNDERWATER PROPULSION AID AND UNDERWATER GARMENT EQUIPPED WITH THE SAME

(71) Applicant: Kohei Nakamura, Sapporo (JP)

(72) Inventor: Kohei Nakamura, Sapporo (JP)

( * ) Notice: Subject to any disclaimer, the term of this patent is extended or adjusted under 35 U.S.C. 154(b) by 0 days.

(21) Appl. No.: 14/815,239

(22) Filed: Jul. 31, 2015

(65) Prior Publication Data

US 2016/0038790 A1 Feb. 11, 2016

(30) Foreign Application Priority Data

Aug. 7, 2014 (JP) ..... 2014-161848

(51) Int. Cl.
*A63B 31/12* (2006.01)

(52) U.S. Cl.
CPC ..... *A63B 31/12* (2013.01)

(58) Field of Classification Search
CPC ..... A63B 31/12
USPC ..... 441/59–64
See application file for complete search history.

(56) References Cited

U.S. PATENT DOCUMENTS

| | | | | | |
|---|---|---|---|---|---|
| 1,260,931 | A * | 3/1918 | Melhuse | A63B 31/14 | 441/60 |
| 1,688,498 | A * | 10/1928 | Jacobsen | A63B 31/14 | 441/62 |
| 2,898,611 | A * | 8/1959 | Mooney | A63B 31/14 | 441/60 |
| 3,109,186 | A * | 11/1963 | Glenn | A63B 31/12 | 441/60 |
| 3,286,287 | A * | 11/1966 | Martin | A63B 31/08 | 441/57 |
| 4,721,300 | A * | 1/1988 | Guzman | A63B 21/0084 | 482/111 |
| 5,326,296 | A * | 7/1994 | De Jesus | A63B 31/11 | 441/60 |
| 5,338,235 | A * | 8/1994 | Lee | A63B 31/12 | 441/59 |
| 7,285,030 | B1 * | 10/2007 | Houck | A63B 31/12 | 441/60 |
| 8,246,404 | B1 * | 8/2012 | Sweet | A63B 31/11 | 441/60 |
| 2011/0151733 | A1 * | 6/2011 | Gadler | B63C 9/093 | 441/64 |
| 2011/0250806 | A1 * | 10/2011 | Bailey | A63B 31/12 | 441/60 |

FOREIGN PATENT DOCUMENTS

| | | | |
|---|---|---|---|
| DE | 00839463 | B | 5/1952 |
| EP | 0819450 | A1 | 1/1998 |
| FR | 00736340 | A | 11/1932 |
| FR | 2945455 | A1 | 11/2010 |
| GB | 1041324 | A | 9/1966 |
| JP | 11-4255 | Y1 | 4/1936 |
| JP | 42-006030 | Y1 | 3/1967 |
| JP | 59-141802 | U | 9/1984 |
| JP | 62-128561 | U | 8/1987 |
| JP | 03-044402 | U | 4/1991 |
| JP | 05-013471 | U | 2/1993 |
| JP | 2002-514484 | A | 5/2002 |
| JP | 2008-230440 | A | 10/2008 |
| KR | 10-0375775 | B1 | 2/2003 |
| WO | 2009/085301 | A1 | 7/2009 |

* cited by examiner

*Primary Examiner* — Lars A Olson
*Assistant Examiner* — Jovon Hayes
(74) *Attorney, Agent, or Firm* — Muncy, Geissler, Olds & Lowe, P.C.

(57) ABSTRACT

Provided are an underwater propulsion aid and an underwater garment equipped with the same that enable a user to walk on land or get on or off a boat or the like while wearing them, that have high fashionability and safety, and that enable even a user with weak muscular strength and a user having no experience of using them to easily obtain a propulsive force in water. An underwater propulsion aid 1 includes a base portion 2 that is formed in accordance with a curved shape of a shank and that is fitted to a part from a knee to an ankle, and a pair of front fins 3 that are protruded to right and left outer sides from both right and left side surfaces of the base portion 2 while continuing to a curved surface of a shin.

5 Claims, 12 Drawing Sheets

UNDERWATER PROPULSION AID AND UNDERWATER GARMENT EQUIPPED WITH THE SAME

BACKGROUND OF THE INVENTION

1. Field of the Invention

The present invention relates to an underwater propulsion aid and an underwater garment equipped with the same that aids underwater propulsion of a user who needs to move quickly in water, for example, during lifesaving, scuba diving, skin diving, water sports, and underwater construction.

2. Description of the Related Art

Conventionally, foot fins have been known as a tool for aiding underwater propulsion. Also, Japanese Patent Laid-Open No. 2008-230440 proposes a side type diving fin having a wedge shape in section that is sharpened toward a foot while extending outward from both legs of a body in a part from the vicinity of a knee to the vicinity of a malleolus.

However, it is difficult for a user to walk on land or get on or off a boat or the like while wearing the conventional foot fins. If the user forces himself/herself to walk while wearing the foot fins, the user walks in an awkward manner. Also, since the conventional foot fins are not fashionable, it is embarrassing to walk along a beach or a poolside. Moreover, when the user gets on or off a boat or the like while wearing the foot fins, the user possibly loses his/her footing to cause an accident or be injured.

Also, the side type diving fin described in Japanese Patent Laid-Open No. 2008-230440 has a shape extending largely outward from the leg. Thus, when a propulsive force is generated in water, only an outer side of the leg receives large resistance of water, and toes are twisted in an outward direction. Unless the user has exceptionally high muscular strength, it is not possible to flap the side type diving fin in a correct direction. Thus, there has been the problem that a sufficient propulsive force cannot be obtained.

The present invention has been made to solve the above problems, and an object thereof is to provide an underwater propulsion aid and an underwater garment equipped with the same that enable a user to walk on land or get on or off a boat or the like while wearing them, that have high fashionability and safety, and that enable even a user with weak muscular strength and a user having no experience of using them to easily obtain a propulsive force in water.

SUMMARY OF THE INVENTION

An underwater propulsion aid according to the present invention includes a base portion that is formed in accordance with a curved shape of a shank and that is fitted to a part from a knee to an ankle, and a pair of front fins that are protruded to right and left outer sides from both right and left side surfaces of the base portion while continuing to a curved surface of a shin.

As one aspect of the present invention, a pair of rear fins that are protruded to the right and left outer sides from the both right and left side surfaces of the base portion while continuing to a curved surface of a calf may be provided at positions behind the pair of front fins.

As one aspect of the present invention, the pair of rear fins may be protruded more largely in an outward direction than the pair of front fins.

As one aspect of the present invention, a front surface-side recessed curved surface that is curved in a recessed shape in cross section may be formed in a front surface of each of the rear fins, a back surface-side recessed curved surface that is curved in a recessed shape in cross section may be formed in a back surface of each of the rear fins, and the front surface-side recessed curved surface may be arranged on an outer side with respect to the back surface-side recessed curved surface.

As one aspect of the present invention, the pair of front fins may have substantially the same surface area on right and left sides, and the pair of rear fins may have substantially the same surface area on right and left sides.

As one aspect of the present invention, the base portion may have an opening along the shin.

As one aspect of the present invention, a groove width of a recessed groove formed between each of the front fins and the base portion may be formed to become smaller from a vertical center portion toward an upper end portion and a lower end portion, respectively.

As one aspect of the present invention, a backward curved portion that is curved backward may be formed at the lower end portion of each of the front fins.

As one aspect of the present invention, the underwater propulsion aid includes a shoe portion that is wearable on a foot, wherein a pair of fixed fins that are protruded to the right and left outer sides from both right and left side end portions may be provided on an upper surface side of the shoe portion.

As one aspect of the present invention, the shoe portion may include a fin accommodating space that penetrates a shoe sole portion in a slit shape in a right-left direction, a swing shaft that is provided at a front end portion or a rear end portion of the fin accommodating space, and a pair of swing fins that are pivotably supported swingably about the swing shaft, and each of the swing fins may be swung between an accommodated position where the swing fin is accommodated in the fin accommodating space, and a protruded position where the swing fin is protruded from the fin accommodating space in the right-left direction.

As one aspect of the present invention, the pair of swing fins may be protruded more largely in the outward direction than the pair of fixed fins when swung to the protruded position.

As one aspect of the present invention, a slide fastener may be provided along each opening portion of the fin accommodating space, and the slide fastener may be closed when a slider is moved to the swing shaft side.

An underwater garment according to the present invention includes the underwater propulsion aid according to any one of the above aspects.

In accordance with the present invention, the underwater propulsion aid and the underwater garment equipped with the same enable a user to walk on land or get on or off a boat or the like while wearing them, have high fashionability and safety, and enable even a user with weak muscular strength and a user having no experience of using them to easily obtain a propulsive force in water.

DETAILED DESCRIPTION OF THE PREFERRED EMBODIMENTS

Figure 1:
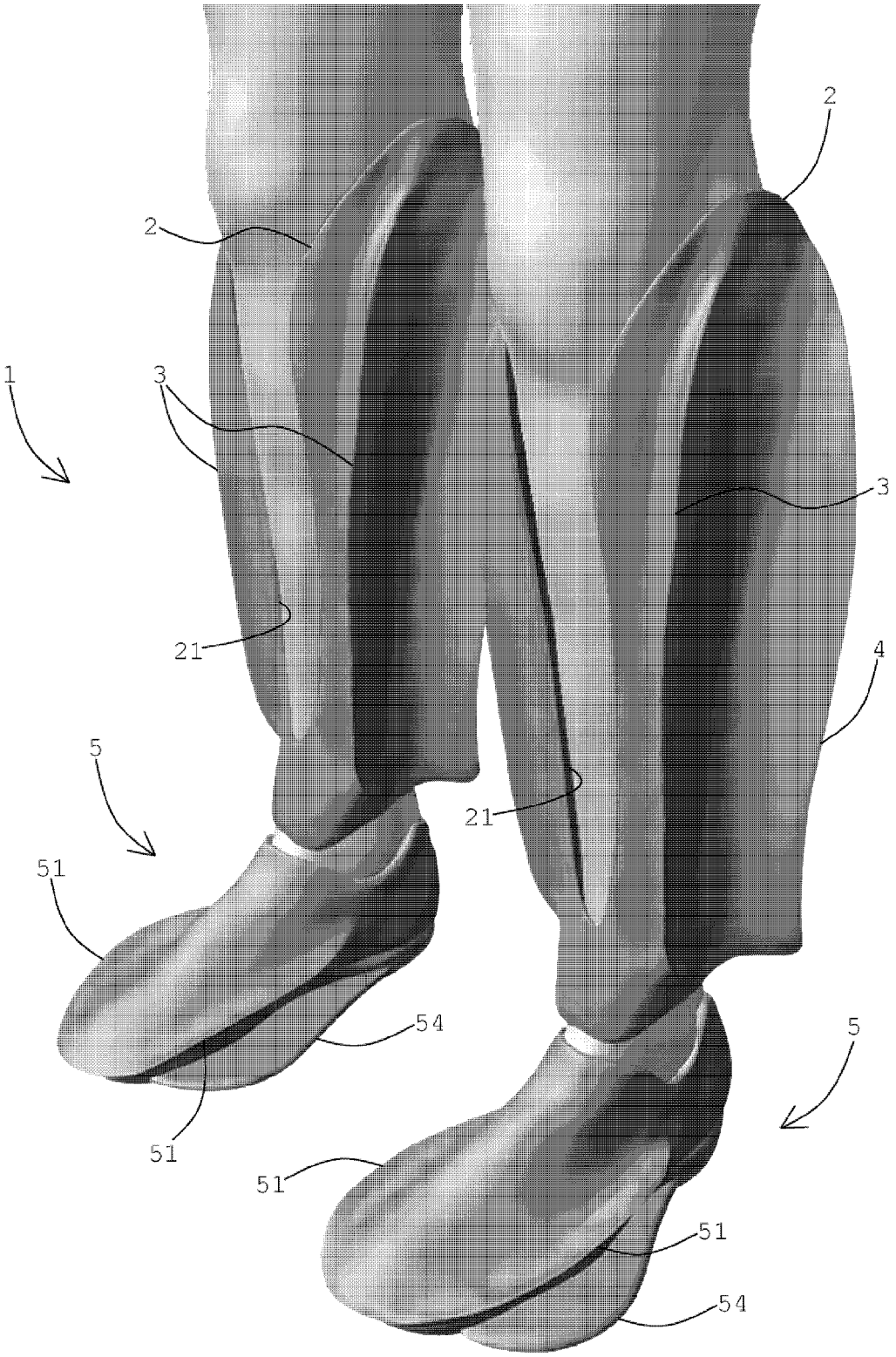
FIG. 1 is a perspective view illustrating one embodiment of an underwater propulsion aid according to the present invention.
Figure 2:
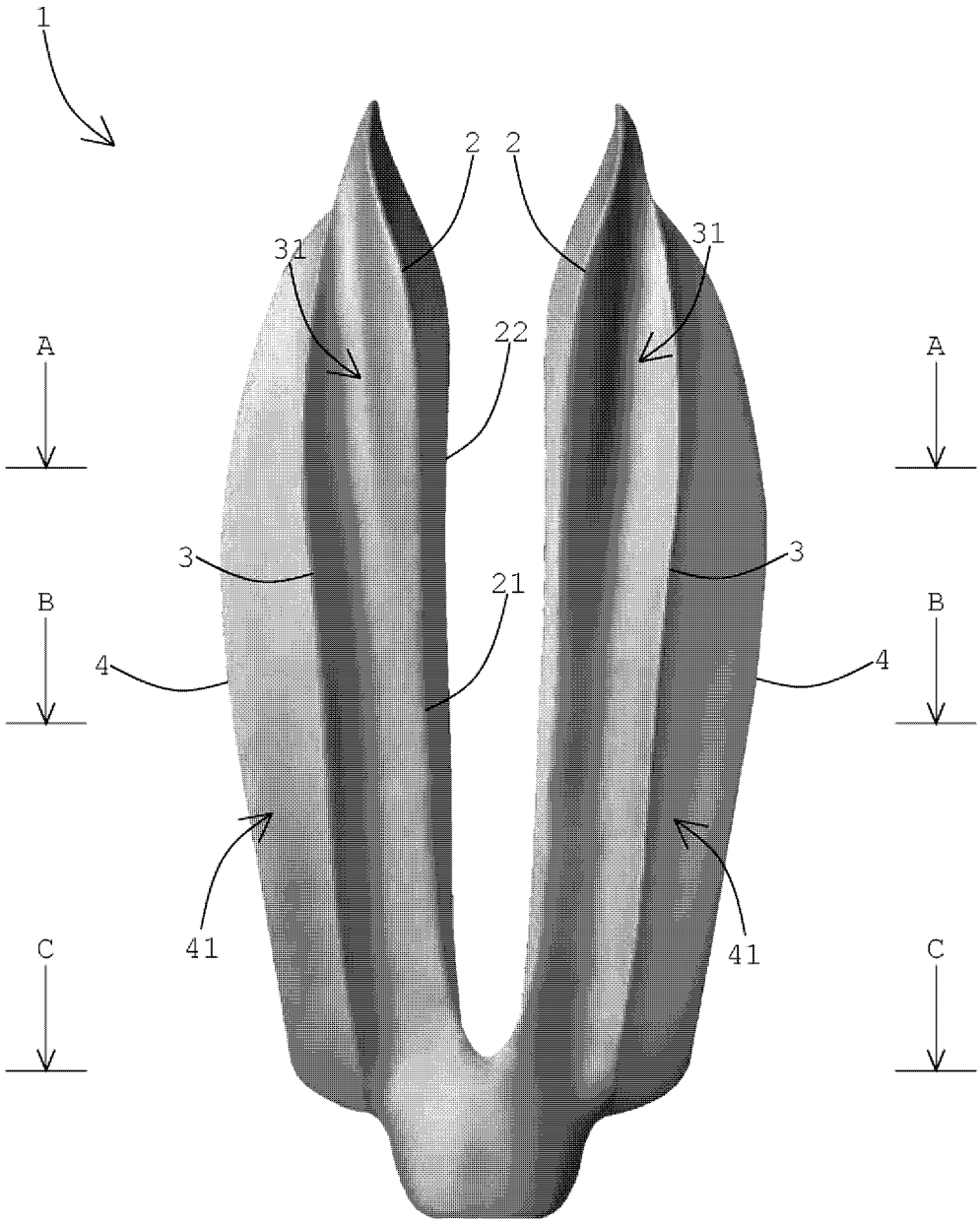
FIG. 2 is a front view illustrating the underwater propulsion aid of the present embodiment.
Figure 3:
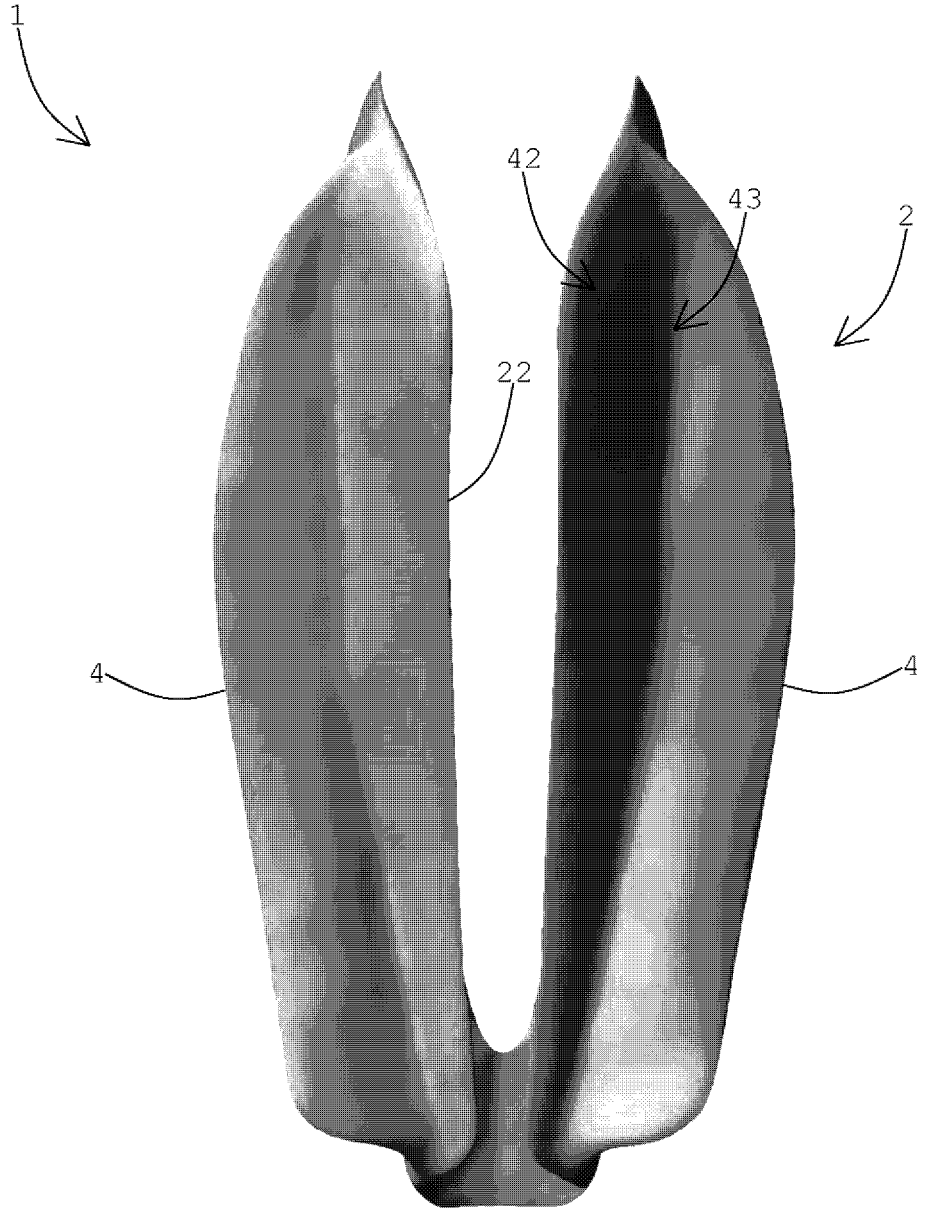
FIG. 3 is a back view illustrating the underwater propulsion aid of the present embodiment.

In the following, one embodiment of an underwater propulsion aid 1 according to the present invention is described by using the drawings. In the present invention, as terms related to a human leg, a "shank" is used for a part from a knee to a malleolus, and a "foot" is used for a part below the malleolus.

As shown in FIGS. 1 to 6, the underwater propulsion aid 1 of the present embodiment includes a base portion 2 that is fitted to a part from the knee to an ankle, a pair of front fins 3 that are protruded to right and left outer sides from both right and left side surfaces of the base portion 2, a pair of rear fins 4 that are protruded to the right and left outer sides from the both right and left side surfaces of the base portion 2 at positions behind the pair of front fins 3, and a shoe portion 5 that can be worn on the foot. In the following, the respective constituent portions are described.

The base portion 2 is used for fitting the underwater propulsion aid 1 to each of the legs of a user. In the present embodiment, the base portion 2 is made of a rubber material or a synthetic resin etc. having excellent elasticity and durability. As shown in FIGS. 1 to 6, the base portion 2 is formed in accordance with a curved shape of the shank between the knee and the malleolus such that an inner surface of the base portion 2 comes into close contact with the shank.

Meanwhile, the base portion 2 has a front opening 21 that opens along a shin (a front surface portion of the shank), and a rear opening 22 that opens along a calf (a rear surface portion of the shank) such that the shin and the calf are exposed. The openings 21 and 22 improve ease of fitting and a cool sensation. A shape from the front opening 21 to the base portion 2 is formed to depict a continuous curve from the shin along the shin such that a resistance force in water is reduced. Similarly, a shape from the rear opening 22 to the base portion 2 is formed to depict a continuous curve from the calf along the calf such that the resistance force is reduced when a user flips his/her leg up to a rear side.

Although a weight decrease is achieved by providing the front opening 21 and the rear opening 22 in the base portion 2 and thereby using a part of the body of a user as the fin in the present embodiment, the present invention is not limited to the configuration. For example, the base portion 2 may be formed in a tubular shape such as a leg warmer without providing the front opening 21 and the rear opening 22 in the base portion 2. Also, in order to prevent the base portion 2 from being detached from the shank, a band-like transparent belt (not shown) may be provided around an upper end portion of the base portion 2, and the base portion 2 may be fitted by tightening the belt.

The front fins 3 generate a propulsive force by pushing water aside. In the present embodiment, the right and left pair front fins 3 are employed. As shown in FIG. 1, the right and left pair front fins 3 are protruded to the right and left outer sides from the both right and left side surfaces of the base portion 2 while continuing to a curved surface of the shin. Accordingly, each of the front fins 3 receives and captures water pushed aside to both sides by the shin, and also passes the water backward by pushing out the water, to thereby generate a propulsive force.

Figure 4:
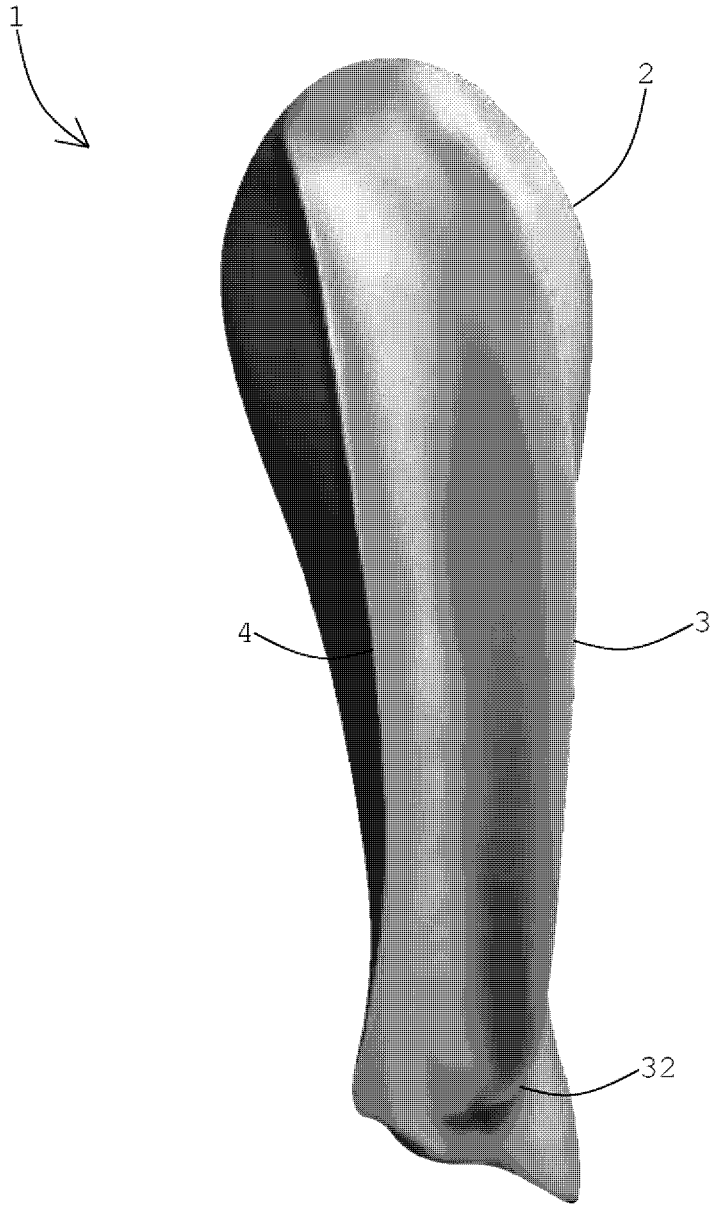
FIG. 4 is a left side view illustrating the underwater propulsion aid of the present embodiment.
Figure 5:
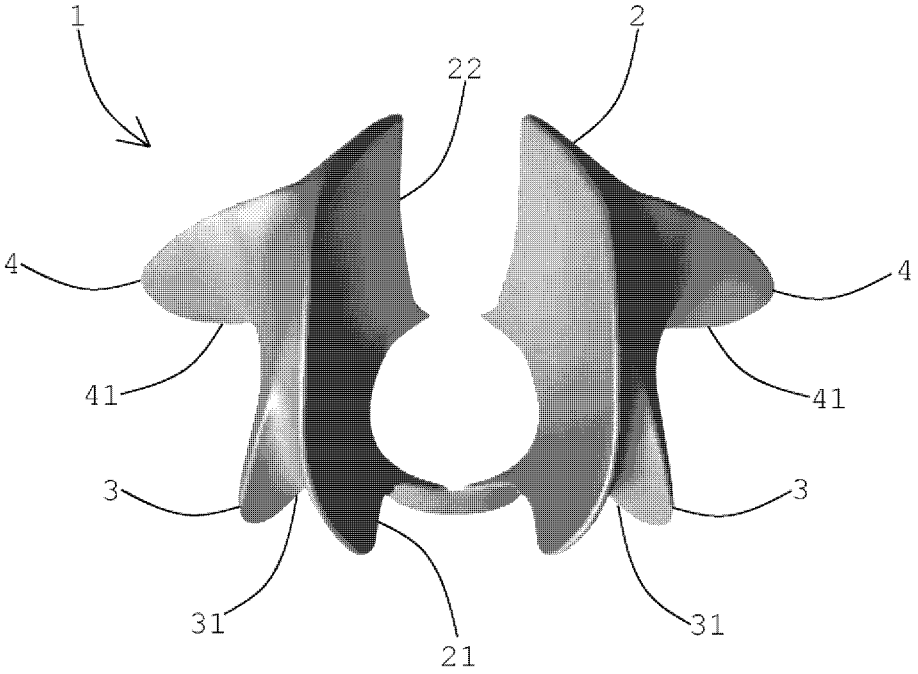
FIG. 5 is a plan view illustrating the underwater propulsion aid of the present embodiment.
Figure 6:
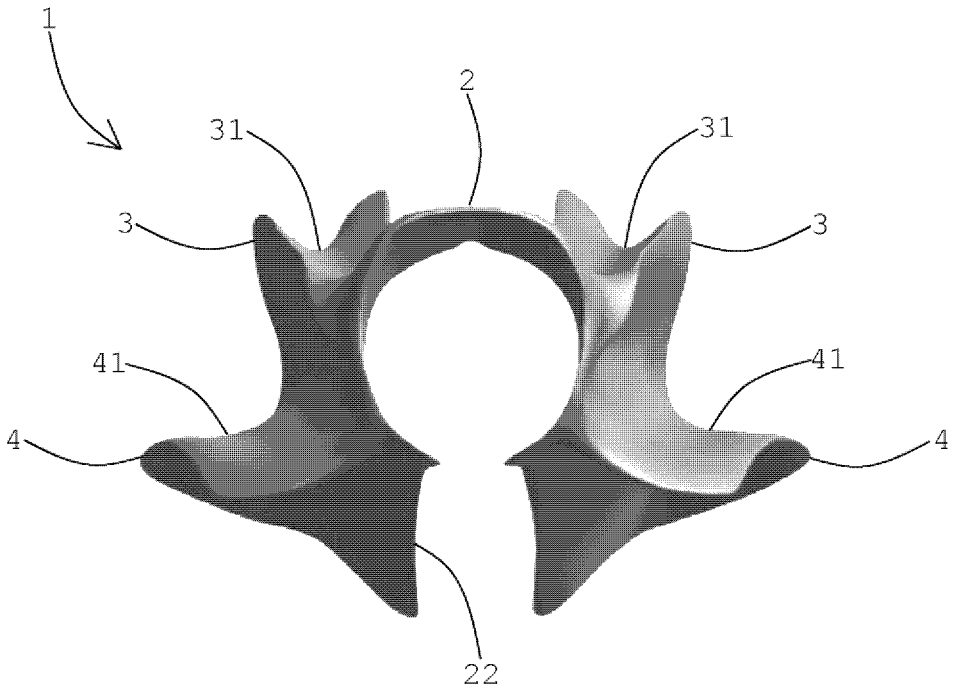
FIG. 6 is a bottom view illustrating the underwater propulsion aid of the present embodiment.

In the present embodiment, a recessed groove 31 is also formed in each of the front fins 3 along the shin as shown in FIGS. 2 and 7A to 7C such that water is easily captured. Meanwhile, a groove width of the recessed groove 31 is formed to become smaller from a vertical center portion toward an upper end portion and a lower end portion, respectively, so that water is gradually captured and gradually released in water. Moreover, in the present embodiment, a backward curved portion 32 that is curved backward is formed at the lower end portion of each of the front fins 3 as shown in FIG. 4. Therefore, water received on front surface sides of the front fins 3 is smoothly passed to back surface sides from the lower end portions.

Although the front fins 3 are made of the same material as that of the base portion 2 in the present embodiment, the present invention is not limited to the configuration. A different material may be appropriately selected in consideration of a balance between flexibility and stiffness. For example, in a case in which a lateral width of the front fins 3 is relatively small, a hard material may be used, and in a case in which the lateral width is relatively large, a soft material may be used. A material that is hard at a base end portion and becomes smoother and softer toward a distal end portion may be also used.

Figure 7A:
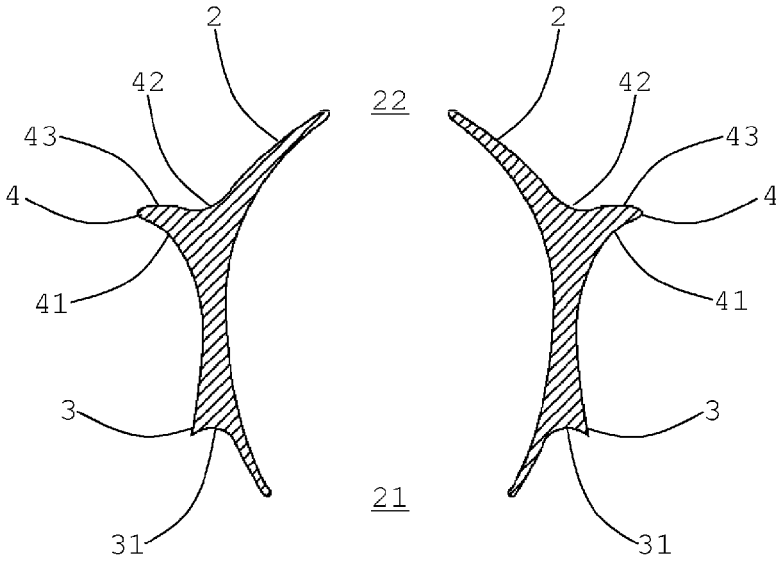
FIGS. 7A, 7B, and 7C are sectional views taken along a line A-A, a line B-B, and a line C-C in FIG. 2, respectively.
Figure 7B:
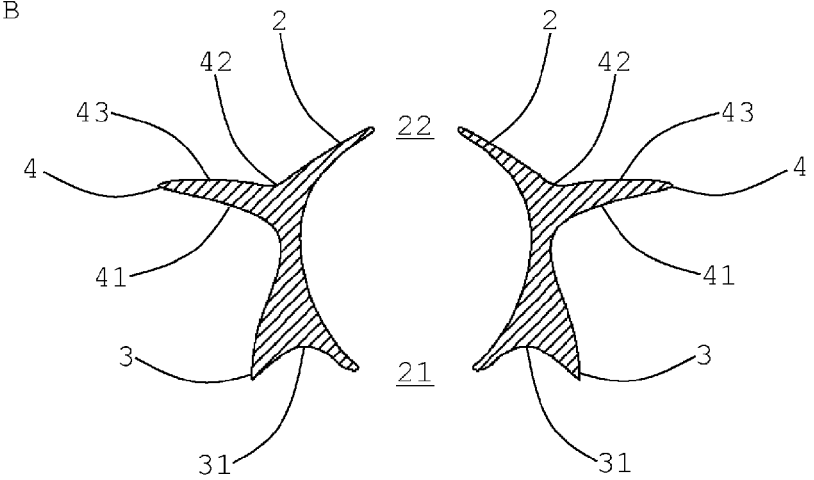
Figure 7C:
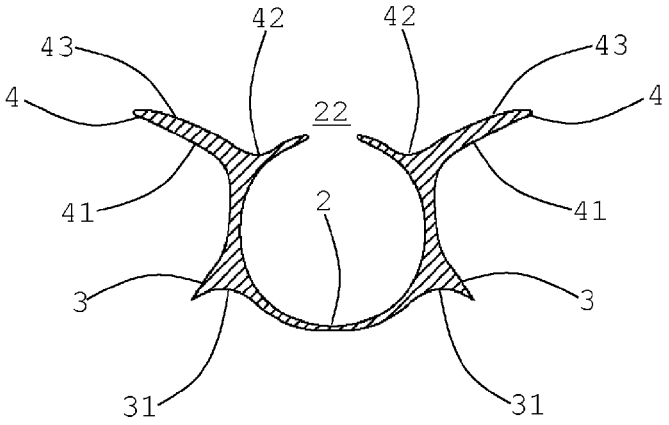

Moreover, in the present embodiment, end portions of the front fins 3 are curved forward as shown in FIGS. 7A to 7C in order to easily capture water. However, the present invention is not limited to the configuration. The front fins 3 only need to be protruded at least to the right and left outer sides.

The right and left pair of rear fins 4 are employed similarly to the front fins 3. The right and left pair of rear fins 4 push aside water that has not been received by the front fins 3, to thereby generate a propulsive force. In the present embodiment, the rear fins 4 are protruded to the right and left outer sides from the both right and left side surfaces of the base portion 2 while continuing to a curved surface of the calf at positions behind the pair of front fins 3 as shown in FIGS. 1 to 6. Each of the rear fins 4 is protruded more largely in an outward direction than each of the front fins 3. Accordingly, the rear fins 4 effectively receive and capture water that has not been received by the front fins 3 to disperse resistance of water, and pass the water backward while pushing out the water, to thereby generate a larger propulsive force. Therefore, even when the front fins 3 are formed to be relatively small so as to reduce the resistance, the rear fins 4 can cover decrease of the propulsive force.

In the present embodiment, a front surface-side recessed curved surface 41 that is curved in a recessed shape in cross section is formed in a front surface of each of the rear fins 4, and a back surface-side recessed curved surface 42 that is curved in a recessed shape in cross section is formed in a back surface of each of the rear fins 4 as shown in FIGS. 7A to 7C. The front surface-side recessed curved surface 41 is arranged on an outer side with respect to the back surface-side recessed curved surface 42. Accordingly, the front surface-side recessed curved surface 41 makes it easy to capture water that is to escape to the outer side of each of the rear fins 4.

A projecting curved surface 43 that is curved in a projecting shape in cross section is also formed on the back surface of each of the rear fins 4 on the outer side with respect to the back surface-side recessed curved surface 42. Therefore, when a user bends his/her knee, the back surface-side recessed curved surface 42 receives water to generate a certain level of propulsive force. On the other hand, water pushed aside by the back surface-side recessed curved surface 42 is smoothly passed outward by the projecting curved surface 43, so that the resistance of water received by the rear fins 4 when the user bends his/her knee is reduced.

Moreover, in the present embodiment, the pair of front fins 3 have substantially the same surface area on the right and left sides, and the pair of rear fins 4 have substantially the same surface area on the right and left sides. Therefore, substantially the same resistance of water is applied to the right and left sides of each legs, and no load is generated in a twisting direction. Thus, a burden on the legs and the knees is made as small as possible. Note that substantially the same in the present invention is a concept including not only completely the same state, but also a slightly different state due to a manufacturing error or the like within a range in which the above effects can be produced.

Note that projecting widths (lateral widths) of the front fins 3 and the rear fins 4 are set to sizes in which the front fins 3 and the rear fins 4 do not disturb a user when the user walks on land or gets on or off a boat or the like. Even when the front fins 3 and the rear fins 4 have the sizes as described above, the front fins 3 and the rear fins 4 have a vertically long area. Thus, the function of receiving water and generating a propulsive force is ensured.

Figure 8A:
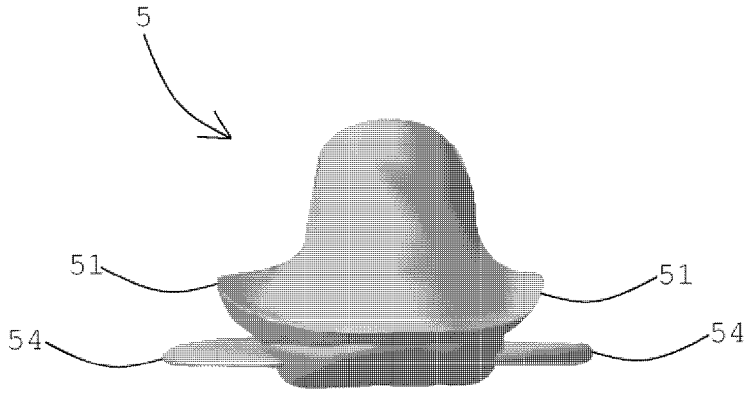
FIGS. 8A, 8B, and 8C are a front view, a plan view, and an end view taken along a line D-D illustrating a shoe portion of the present embodiment, respectively.
Figure 8B:
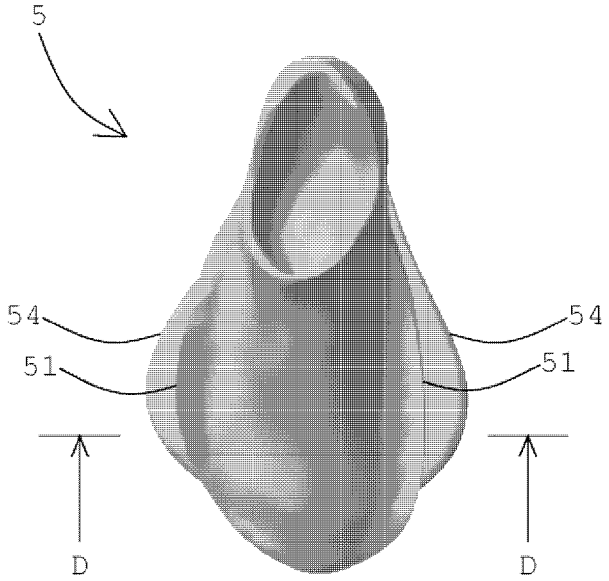
Figure 8C:
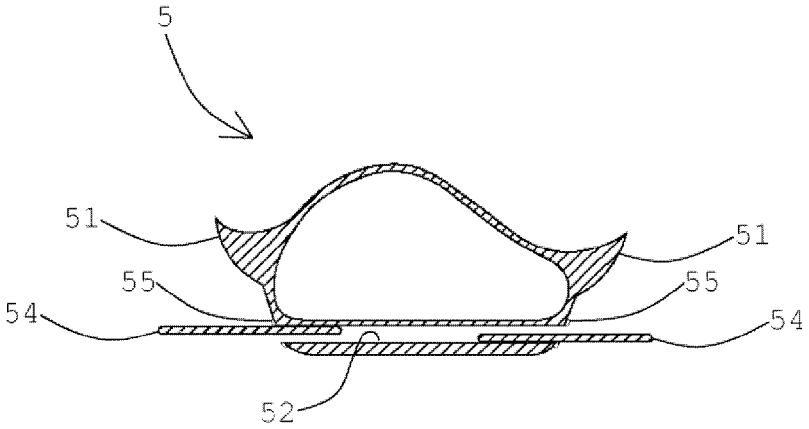

The shoe portion 5 covers and protects the foot. In the present embodiment, the shoe portion 5 is made of the same material as that of the base portion 2, and has the same base structure as those of low shoes. Meanwhile, on an upper surface side, the shoe portion 5 includes a pair of fixed fins 51 that are protruded to the right and left outer sides from both right and left side end portions as shown in FIGS. 1, 8A and 8B. In each of the fixed fins 51, an upper surface is formed into a recessed curved surface as shown in FIG. 8C. Therefore, the fixed fins 51 receive and capture water pushed aside to both sides by a top of the foot, and pass the water backward while pushing out the water, to thereby generate a propulsive force.

Figure 9:
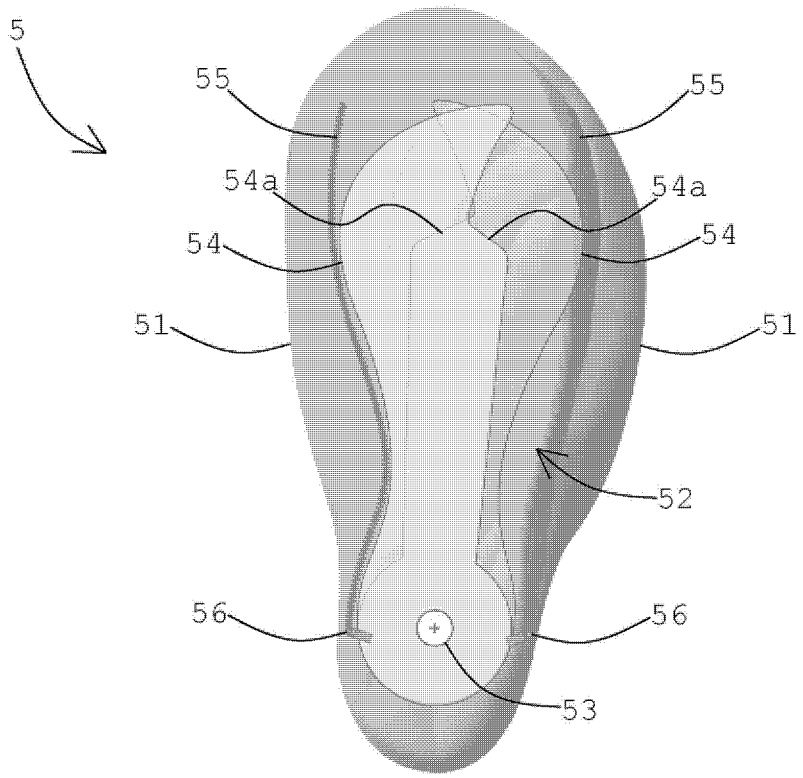
FIG. 9 is a view illustrating an accommodating structure in the shoe portion of the present embodiment.
Figure 10:
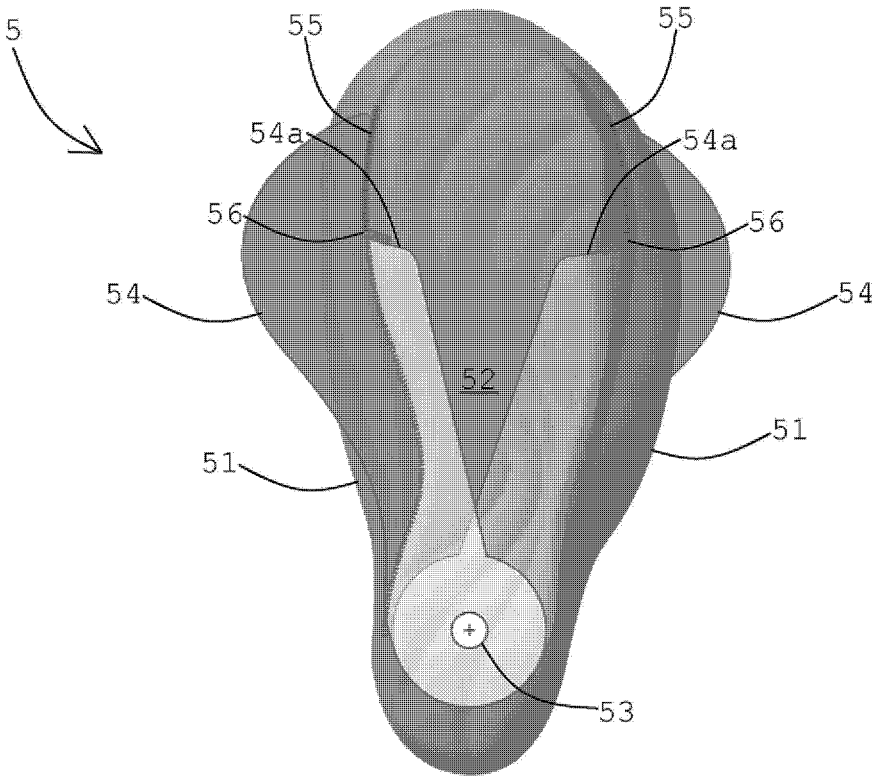
FIG. 10 is a view illustrating a state in which swing fins of the present embodiment are protruded.

In the present embodiment, the shoe portion 5 also includes a fin accommodating space 52 that penetrates a shoe sole portion in a slit shape in a right-left direction, a swing shaft 53 that is provided at a rear end portion of the fin accommodating space 52, and a pair of swing fins 54 that are pivotably supported swingably about the swing shaft 53 as shown in FIGS. 9 and 10. Because of the configuration, each of the swing fins 54 swings between an accommodated position (FIG. 9) where the swing fin 54 is accommodated in the fin accommodating space 52, and a protruded position (FIG. 10) where the swing fin 54 is protruded from the fin accommodating space 52 in the right-left direction.

In the present embodiment, each of the swing fins 54 is formed in a projecting curved shape on a front outer side, and a step portion 54*a* is formed on a front inner side as shown in FIGS. 9 and 10. A slide fastener 55 is also provided so as to be openable and closable along each opening portion of the fin accommodating space 52. Each of the slide fasteners 55 is attached so as to be closed when a slider 56 is moved to the swing shaft 53 side.

Because of the above configuration, as shown in FIG. 10, when the slider 56 is moved in a closing direction after swinging each of the swing fins 54 to the protruded position, the slider 56 stops upon abutting on the step portion 54*a*. Therefore, the slide fastener 55 functions as a stopper that restricts the swing of each of the swing fins 54 in an accommodating direction. When the slide fastener 55 is closed after swinging each of the swing fins 54 to the accommodated position, each of the swing fins 54 is completely accommodated.

In the present embodiment, since the swing shaft 53 is provided at the rear end portion of the fin accommodating space 52, the slide fastener 55 is attached so as to be closed when the slider 56 is moved from a front side to a rear side. However, the present invention is not limited to the configuration. That is, when the swing shaft 53 is provided at a front end portion of the fin accommodating space 52, the slide fastener 55 is attached so as to be closed when the slider 56 is moved from the rear side to the front side, so that the same stopper function can be exerted. Although the step portions 54*a* are provided so as to protrude the swing fins 54 to the same degree in the present embodiment, the step portions 54*a* may not be always formed.

In the present embodiment, each of the swing fins 54 is protruded more largely in the outward direction than each of the fixed fins 51 when protruded to the protruded positions. Accordingly, the swing fins 54 receive and capture water that has not been received by the fixed fins 51 to disperse resistance of water, and pass the water backward while pushing out the water, to thereby generate a larger propulsive force.

Note that projecting widths (lateral widths) of the fixed fins 51 and the swing fins 54 are set to sizes in which the fixed fins 51 and the swing fins 54 do not disturb a user when the user walks on land or gets on or off a boat or the like similarly to the front fins 3 and the rear fins 4. Even when the fixed fins 51 and the swing fins 54 have the sizes as described above, the fixed fins 51 and the swing fins 54 are formed to be long in a front-rear direction. Thus, the function of receiving water and generating a propulsive force is ensured. Since the swing fins 54 are configured to be accommodatable in the present embodiment, the swing fins 54 are accommodated on land and thus do not disturb the user even when the projecting width of the swing fins 54 is set to be large.

Next, an operation of the underwater propulsion aid 1 of the present embodiment is described.

To obtain a propulsive force in water by use of the underwater propulsion aid 1 of the present embodiment, the base portions 2 are fitted to a user from the knees to the ankles, and the shoe portions 5 are worn on the feet as shown in FIG. 1. In this way, each of the shoe portions 5 does not have an unwieldy member, such as a fin, which projects from the toes of the foot, and the respective fins 3, 4, 51, and 54 of the present embodiment are formed with the lateral widths not disturbing the user. Therefore, even when the user walks or gets on or off a boat or the like while wearing the underwater propulsion aid 1, the underwater propulsion aid 1 does not disturb the user at all, and thus has high safety.

Since the underwater propulsion aid 1 has novel and near-futuristic design clearly different from conventional foot fins, the underwater propulsion aid 1 is highly fashionable and gives a smart impression. Furthermore, since each of the base portions 2 has the front opening 21 and the rear opening 22 in the present embodiment, the underwater propulsion aid 1 is easily put on and taken off, and a cool sensation is improved. Also, the beauty of leg lines of the user wearing the underwater propulsion aid 1 is emphasized, and a weight of the underwater propulsion aid 1 is reduced, so that mobility on land and in water is improved.

Moreover, in the present embodiment, when the slide fasteners 55 are closed in a state in which the swing fins 54 are swung to the accommodated positions, the swing fins 54 are accommodated in the fin accommodating space 52 as shown in FIG. 9. Therefore, the swing fins 54 do not unexpectedly jump out of the fin accommodating space 52 when the user walks on land. On the other hand, when the slide fasteners 55 are closed in a state in which the swing fins 54 are swung to the protruded positions, the sliders 56 abut on the step portions 54*a* to restrict the swing of the swing fins 54 in the accommodating direction as shown in FIG. 10. Therefore, the swing fins 54 are quickly and easily fixed at the protruded positions.

When the user wearing the underwater propulsion aid 1 performs knee bending/stretching exercises in water, the respective fins 3, 4, 51, and 54 receive and backwardly push out water, to thereby generate a large propulsive force. To be more specific, when the user stretches his/her knee from a bent state, the shin of the user pushes water aside while backwardly pushing out the water, to thereby generate a propulsive force. At this time, the front fins 3 protruded to the right and left outer sides while continuing to the curved surface of the shin smoothly receive and capture the water pushed aside to the both right and left sides by the shin, and pass the water backward, to thereby generate a propulsive force.

In the present embodiment, since the groove width of the recessed groove 31 formed between each of the front fins 3 and the base portion 2 becomes smaller from the vertical center portion toward the upper end portion and the lower end portion, respectively, water is easily captured from the upper end portion and easily released from the lower end portion. Moreover, in the present embodiment, the backward curved portion 32 provided at the lower end portion of each of the front fins 3 smoothly passes water backward, and thereby reduces the resistance of water.

In the present embodiment, the rear fins 4 more protruded to the right and left outer sides than the front fins 3 and each having the front surface-side recessed curved surface 41 receive and capture the water that has not been received by the front fins 3. The rear fins 4 thereby disperse the resistance of the water, and pass the water backward while pushing out the water, to thereby generate a larger propulsive force. Moreover, in the present embodiment, the front fins 3 and the rear fins 4 have substantially the same surface areas on the right and left sides. Therefore, substantially the same resistance of water is applied to the right and left sides of each shanks of the user, and no load is generated in the twisting direction.

Also, when the user stretches his/her knee from a bent state, the shoe portion 5 generates a propulsive force with the top of the foot pushing water aside. At this time, each of the fixed fins 51 receives and captures the water pushed aside to the both sides by the top of the foot, and passes the water backward while pushing out the water, to thereby generate a propulsive force. Each of the swing fins 54 protruded more largely to the right and left outer sides than each of the fixed fins 51 also receives and captures the water that has not been received by the fixed fins 51 to disperse the resistance of the water. Each of the swing fins 54 passes the water backward while pushing out the water, to thereby generate a larger propulsive force.

On the other hand, when the user bends his/her knee from a stretched state, the calf of the user pushes water aside while pushing out the water, to thereby generate a propulsive force. At this time, the rear fins 4 protruded to the right and left outer sides while continuing to the curved surface of the calf smoothly receive and capture the water pushed aside to the both right and left sides by the calf, and pass the water backward, to thereby generate a propulsive force.

In the present embodiment, in the rear fins 4, the back surface-side recessed curved surfaces 42 receive and backwardly push out water to generate a certain level of propulsive force. At this time, the back surface-side recessed curved surfaces 42 are arranged on an inner side with respect to the front surface-side recessed curved surfaces 41. Thus, although the generated propulsive force is smaller than the propulsive force generated when the user stretches his/her knee from a bent state, a moment required for the action is correspondingly decreased, so that the user easily bends his/her leg. Since the water pushed aside by the back surface-side recessed curved surfaces 42 is smoothly passed backward and outward by the projecting curved surfaces 43, the resistance of water received by the rear fins 4 when the user bends his/her knee is reduced.

As described above, since the underwater propulsion aid 1 of the present embodiment uses even a part of the body of the user, such as the shin, the calf, and the top of the foot, as a portion of the fin, the underwater propulsion aid 1 generates a maximum propulsive force while achieving compact and smart design.

In accordance with the present embodiment as described above, the following effects are produced.

1. A user can walk on land or get on or off a boat or the like even while wearing the underwater propulsion aid 1. Thus, the underwater propulsion aid 1 has excellent fashionability and safety.

2. Underwater propulsion of a user who needs to move quickly in water, for example, during lifesaving, scuba diving, skin diving, water sports, and underwater construction can be aided. Thus, the underwater propulsion aid 1 has excellent practicability.

3. Even a user with weak muscular strength and a beginner having no experience of using the underwater propulsion aid 1 can easily obtain a propulsive force in water.

4. Energy of the bending/stretching exercises performed with the knee as a fulcrum can be efficiently changed into a propulsive force by receiving water pushed aside by the leg by the front fins 3 and the rear fins 4.

5. The rear fins 4 capture water escaping in the right and left directions of the front fins 3, and the swing fins 54 capture water escaping in the right and left directions of the fixed fins 51, so that energy efficiency can be improved.

6. By making equal the loads applied to the right and left sides of each legs via the underwater propulsion aid 1, the legs are prevented from being twisted, so that a propulsive force can be effectively generated.

7. The front opening 21 and the rear opening 22 can achieve a weight decrease while achieving novel design. Thus, even a woman and a child can easily use the underwater propulsion aid 1.

8. The shoe portion 5 can also generate a propulsive force from kinetic energy of the foot.

9. The swing fins 54 can be easily put in and out of the shoe portion 5, so that the swing fins 54 can be easily fixed at the protruded positions, and accommodated at the accommodated positions.

10. The rear fins 4 can generate a propulsive force in both of the cases in which a user stretches his/her knees from a bent state and in which the user bends his/her knees from a stretched state.

11. The body of a user can be caused to effectively function as a portion of the fin.

Figure 11:
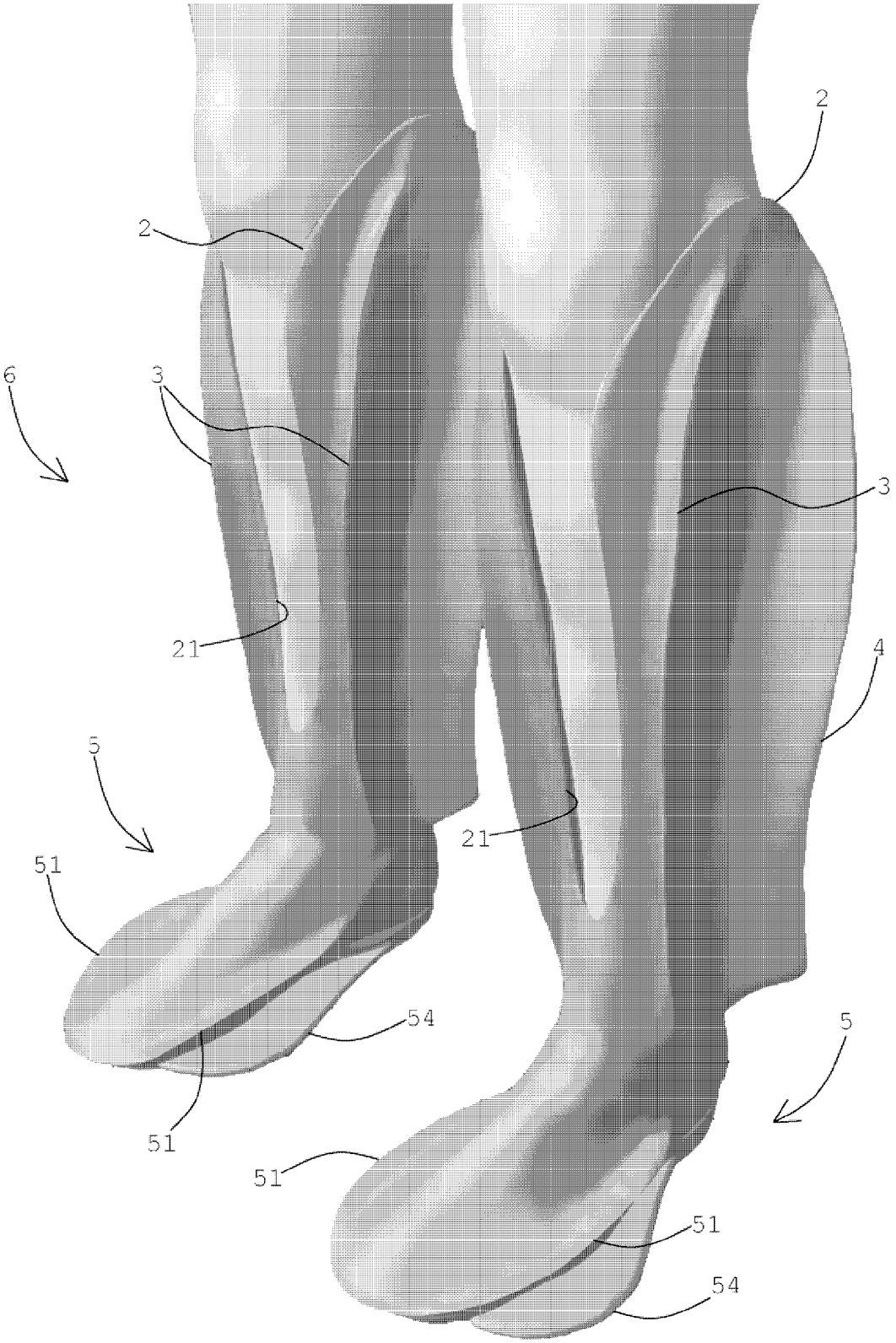
FIG. 11 is a perspective view illustrating another embodiment of an underwater propulsion aid according to the present invention.

Although the underwater propulsion aid 1 of a separated type in which the base portion 2 and the shoe portion 5 are separated from each other is employed in the above embodiment, the present invention is not limited to the configuration. That is, an underwater propulsion aid 6 of an integrated type in which the base portion 2 and the shoe portion 5 are integrally formed as shown in FIG. 11 may be also employed. In accordance with the underwater propulsion aid 6 of the integrated type, since there is no joint around the ankle, a user does not receive extra resistance of water, and receives a less load when extending/stretching his/her knee.

Figure 12:
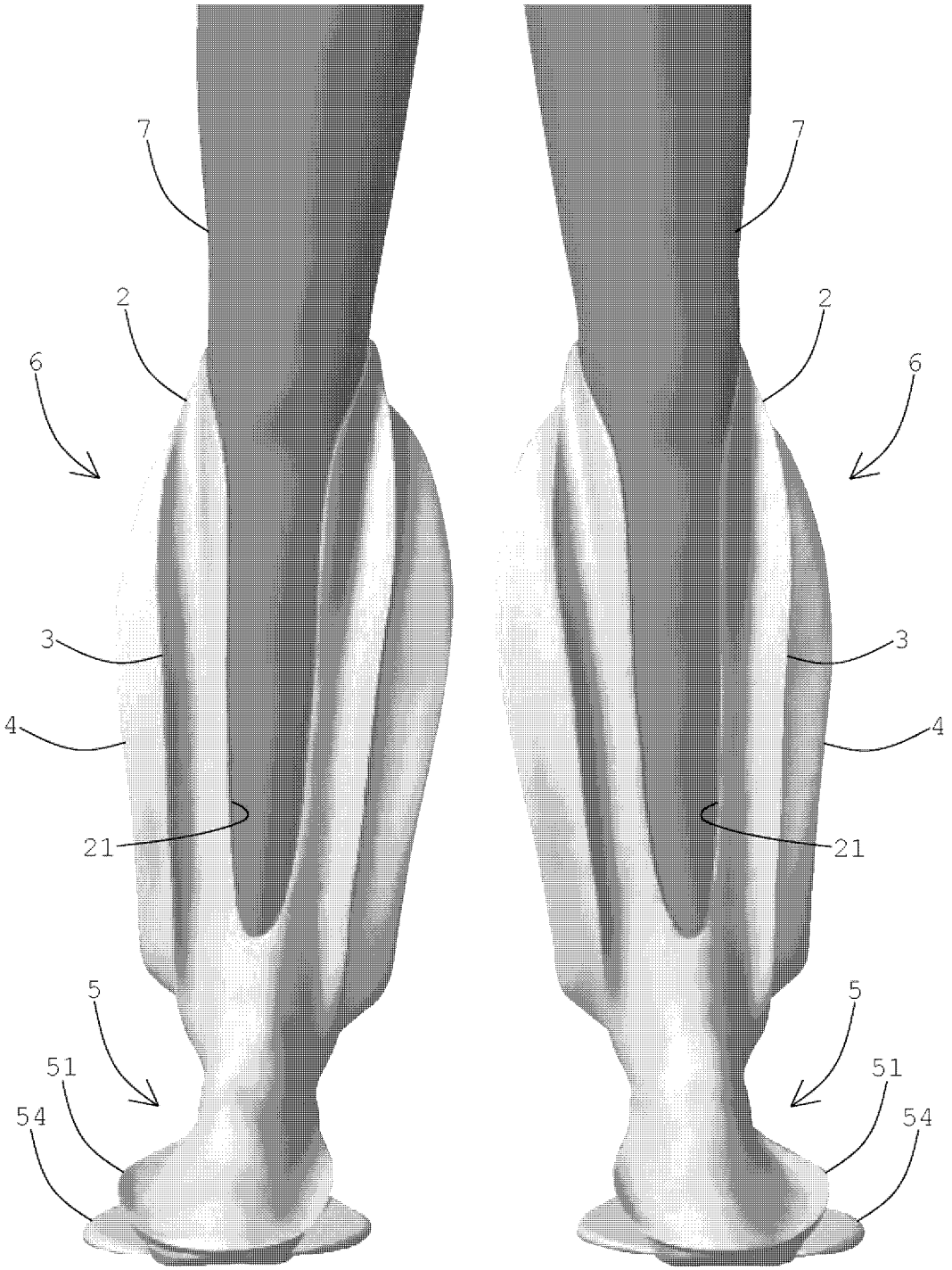
FIG. 12 is a front view illustrating one embodiment of an underwater garment according to the present invention.

Although the underwater propulsion aid 1 is directly fitted to a bare skin in the above embodiment, the present invention is not limited to the configuration. That is, as shown in FIG. 12, the underwater propulsion aid 1 may be fitted onto an underwater garment 7 that is worn in water, such as a wet suit and a dry suit. In this case, it is preferable to provide a hook and loop fastener or the like on each of an inner peripheral surface of the underwater propulsion aid 1 or 6 and an outer surface of the underwater garment 7 so as to quickly and easily integrate and remove the underwater propulsion aid 1 or 6. However, the present invention is not limited to the configuration. The underwater propulsion aid 1 and the underwater garment 7 may be formed integrally with each other, and the front fins 3, the rear fins 4, the fixed fins 51, and the swing fins 54 may be directly attached to the underwater garment 7.

Note that the underwater propulsion aid 1 and the underwater garment 7 equipped with the same according to the present invention are not limited to the aforementioned embodiments, and can be appropriately changed.

For example, although the base portion 2 and the shoe portion 5 as the underwater propulsion aid 1 are used at the same time in the above embodiment, only one of the base portion 2 and the shoe portion 5 may be used alone. Although the underwater propulsion aid 1 is assumed to be used for legs in the above embodiment, the present invention is not limited to the configuration. The underwater propulsion aid 1 may be configured as an underwater propulsion aid for arms including an arm base portion that can be fitted to a part from an elbow to a wrist, and a pair of arm fins that are protruded to right and left outer sides from both right and left side surfaces of the arm base portion while continuing to a curved surface of a forearm.

Moreover, in the above embodiment, all of the front fins 3, the rear fins 4, the fixed fins 51, and the swing fins 54 are formed in a curved shape with a smooth surface. However, the present invention is not limited to the configuration. That is, a small through-hole or a narrow slit etc. may be formed in each of the fins 3, 4, 51, and 54 within a range in which a water curtain is formed by surface tension of water. Accordingly, the weight of the underwater propulsion aid 1 is reduced without decreasing the propulsive force, and flexibility is improved even when the underwater propulsion aid 1 is made of a material having high stiffness. Thus, mobility when a user wears the underwater propulsion aid 1 is improved.

Although both the front fins 3 and the rear fins 4 are provided in the above embodiment, only one pair of the front fins 3 and the rear fins 4 may be provided. When only one pair of the fins is provided, the fins may be arranged close to a position right beside the shank.

Although the swing fins 54 are configured to be swingable in the above embodiment, the present invention is not limited to the configuration. The swing fins 54 may be formed integrally with the shoe portion 5 similarly to the fixed fins 51. Accordingly, a structure of the shoe sole portion is simplified, and a manufacturing cost is reduced.

What is claimed is:

1. An underwater propulsion aid comprising:

a base portion that is formed in accordance with a curved shape of a shank and that is fitted to a part from a knee to an ankle;

a pair of front fins that are continuously provided from the knee to the ankle on both right and left side surfaces of the base portion, and are protruded to right and left outer sides while continuing to a curved surface of a shin; and a pair of rear fins that are continuously provided from the knee to the ankle on the both right and left side surfaces of the base portion at positions behind the pair of front fins, and are protruded to the right and left outer sides while continuing to a curved surface of a calf, wherein the base portion and the pair of front fins, and the base portion and the pair of rear fins are continuously formed by a smooth curve in cross section, and the pair of rear fins are kept in a substantially same direction with respect to the base portion in both of cases in which a user stretches his/her knee from a bent state and in which the user bends his/her knee from a stretched state.

2. The underwater propulsion aid according to claim 1, wherein a recessed groove composed of a recessed curved portion in cross section is formed between each of the front fins and the base portion, and a groove width of the recessed groove is formed to become smaller from a vertical center portion toward an upper end portion and a lower end portion, respectively.

3. The underwater propulsion aid according to claim 1, wherein a backward curved portion that is curved backward such that a back surface becomes a recessed curved surface is formed at the lower end portion of each of the front fins.

4. The underwater propulsion aid according to claim 1, wherein a through-hole or a slit over which a water curtain is formed is formed in the pair of front fins and/or the pair of rear fins.

5. An underwater garment comprising the underwater propulsion aid according to claim 1.

* * * * *